United States Patent [19]

Hillerström

[11] 4,330,035

[45] May 18, 1982

[54] HEAT EXCHANGER

[75] Inventor: Björn Hillerström, Onsala, Sweden

[73] Assignee: AB CTC, Ljungby, Sweden

[21] Appl. No.: 72,564

[22] Filed: Sep. 4, 1979

[51] Int. Cl.[3] ..... F28D 7/02; F28D 7/10

[52] U.S. Cl. ..... 165/164; 165/154; 165/157; 165/174

[58] Field of Search ..... 165/164, 157, 159, 154, 165/174; 138/38, 114, 111

[56] References Cited

U.S. PATENT DOCUMENTS

| | | | |
|---|---|---|---|
| 2,091,274 | 8/1937 | Eggleston | 138/38 |
| 2,401,797 | 6/1946 | Rasmussen | 165/164 X |
| 2,979,310 | 4/1961 | Nicholson | 165/164 X |
| 3,439,739 | 4/1969 | Jaeger | 165/164 |
| 3,734,135 | 5/1973 | Mosler | 138/38 |
| 4,111,402 | 9/1978 | Barbini | 138/38 X |

FOREIGN PATENT DOCUMENTS

| | | | |
|---|---|---|---|
| 897417 | 7/1949 | Fed. Rep. of Germany | 165/164 |
| 991316 | 10/1951 | France | 165/164 |
| 490727 | 8/1938 | United Kingdom . | |
| 490728 | 8/1938 | United Kingdom . | |

*Primary Examiner*—Larry Jones

*Attorney, Agent, or Firm*—Larson and Taylor

[57] ABSTRACT

The invention concerns a heat exchanger which is intended for exchanging heat between a first medium passing through a tube system and a second medium which flows around the tube system whereby the tube system comprises a plurality of tubes which are connected in parallel between an inlet and an outlet for the first medium. The tube system is enclosed in a casing which is composed of two halves, which casing is so designed that a channel is formed for the second medium from an inlet to an outlet for this second medium, said channel being formed by mutually substantially parallel parts connected with each other by means of substantially semi-circular parts. The channel comprises the tubes which form the tube system, said tubes having corresponding straight parts and semi-circular parts. The tubes, which may be provided with cross grooves, can be arranged in a direction which is perpendicular to the mean plane of the casing and can be flattened in this direction.

11 Claims, 8 Drawing Figures

HEAT EXCHANGER

SUMMARY OF THE INVENTION

The present invention concerns a heat exchanger which is intended for exchanging heat between a first medium passing through a tube system and a second medium which flows around the tube system. The tube system comprises a plurality of tubes which are connected in parallel between an inlet and an outlet for the first medium.

The invention has for its purpose to give a heat exchanger which can be manufactured in a simple way which results in low costs and which has a high efficiency, i.e. a high coefficient of thermal conductance from one medium to the other.

BRIEF DESCRIPTION OF THE DRAWINGS

The invention which presents features according to the annexed claims will be described below in connection with a preferred embodiment and with reference to the annexed drawing where FIG. 1 partly in section shows a plan view of the heat exchanger.

DESCRIPTION OF THE PREFERRED EMBODIMENT

Figure 1:
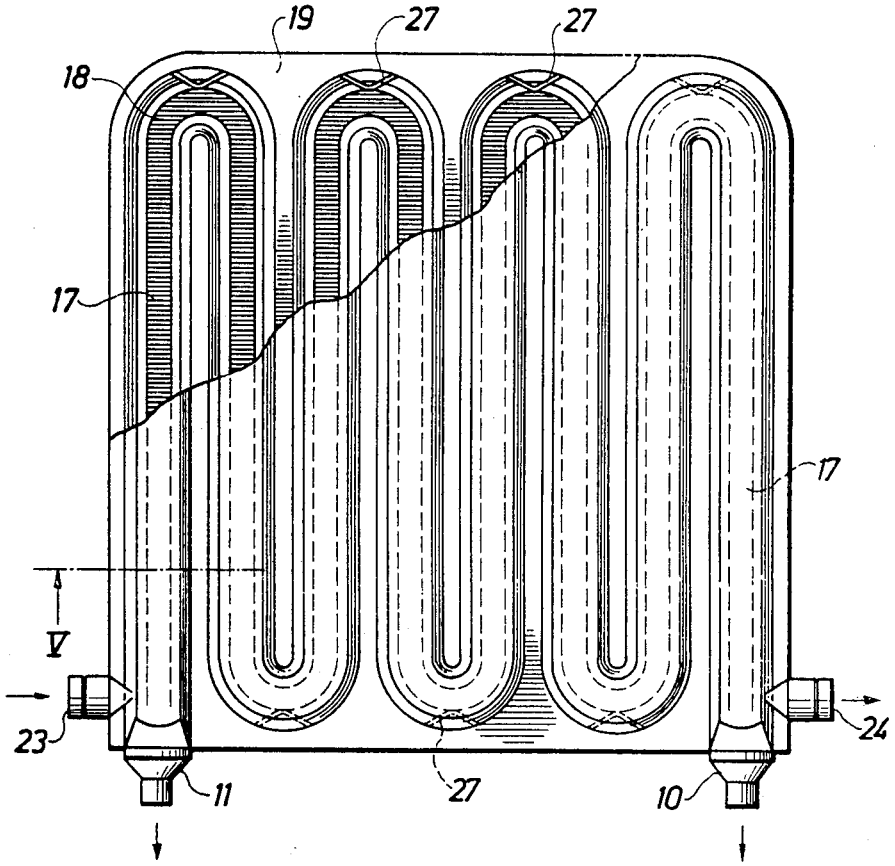
Figure 4:
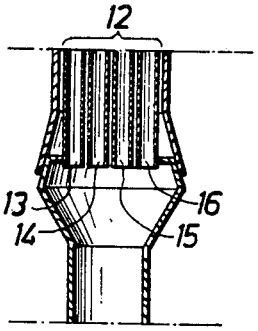

The first medium is supplied to an inlet 10 shown in FIG. 1 and it leaves the heat exchanger through an outlet 11. As can be seen in FIG. 4 which on a greater scale and in a section shows the inlet 10, this inlet is connected to a tube system 12 consisting of four tubes 13,14,15 and 16 and it is assumed that the outlet 11 is designed in a similar way.

Figure 5:
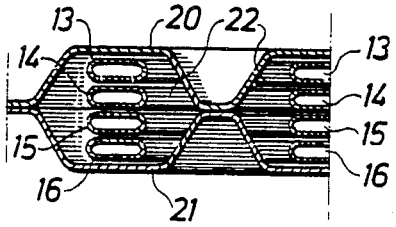

As can be seen in FIG. 5 which shows a section along a plane indicated V in FIG. 1 the tubes 13,14,15 and 16 are flattened and arranged in such a way that a narrow slit is formed between adjacent tubes. In the embodiment shown in the drawing it is assumed that the tube system comprises four tubes which are connected in parallel and flattened, but the invention is not restricted to this number of tubes. In some applications it may be suitable to have a larger or smaller number of tubes in the tube system.

Figure 2:
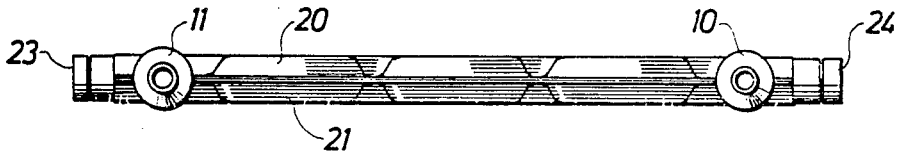
FIG. 2 shows the heat exchanger from below.

As can be seen in FIG. 1 the tube system 12 which is connected between the inlet 10 and the outlet 11 is bent into a modified zig-zag form so that a number of straight parts 17 are formed which are connected with each other by means of semi-circular parts 18. The tube system is placed in a casing 19 which is made of two halves 20 and 21 (FIGS. 2 and 5). Each half consists of a form-pressed metal sheet which by means of the form-pressing has been given such a form that a channel 22 is formed when the two halves are placed against each other and the one half is reversed. The channel 22 surrounds the tube system 12 and extends from an inlet 23 to an outlet 24 for the second medium.

Figure 3:
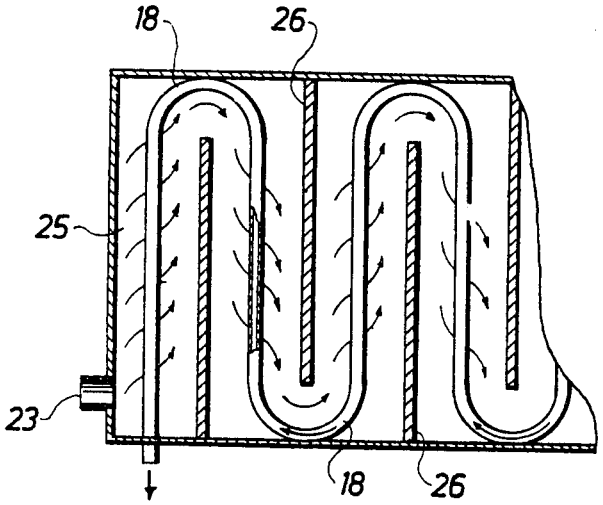
FIG. 3 shows schematically the configuration of flow for the various media through the heat exchanger and FIGS. 4 and 5 show on a greater scale and in a section details of the heat exchanger.

The flow pattern for the two media and especially for the second medium which is obtained in this way is shown schematically in FIG. 3. The second medium enters through the inlet 23 whereupon it is forced through the narrow slits between the tubes 13–16 of the tube system within the straight part of the channel 22 designated 25. As indicated schematically in FIG. 3 there is no direct connection on the outer side to the semi-circular part 18 between two successive straight parts of the channel 22 and this gives as a result that the second medium will again be forced through the narrow slits in the tube system 12 after it has passed the schematically shown partition 26. This means that the second medium will be forced to and fro in the narrow slits of the tube system under repeated changes of direction. The same result is achieved in the embodiment shown in FIG. 1 in that small plates 27 are placed in the channel 22 in such a way that a medium flow along the outer side of the semi-circular parts 18 of the tubes is prevented. In this way the second medium is forced to flow through the narrow slits of the tube system.

In order to increase the coefficient of thermal conductance it is advantageous to make the tubes 13–16 of the tube system with cross grooves in a manner known per se. Cross grooves of this kind which are previously known for resistance from the Swedish patent 363,164 also contribute to give the narrow slit between two adjacent tubes and between the outer tubes and the casing 19 an optimal width so that the desired high coefficient of thermal conductance can be achieved. In an alternative embodiment the flattened tubes may be smooth and in such case metal strips which have a relief pattern in the transverse direction may be positioned between the tubes and between the tubes and the casing so that the height of this relief pattern determines the width of the slits.

Figure 6:
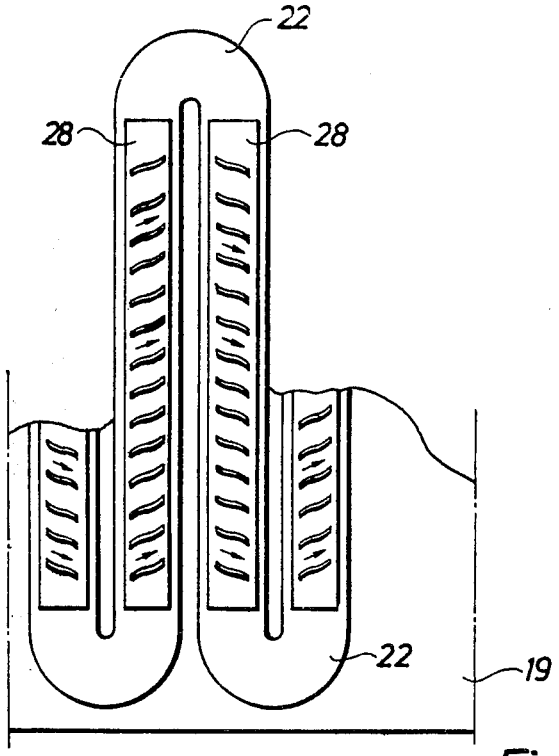
FIGS. 6,7 and 8 show various types of metal strips which may be placed in the heat exchanger.
Figure 7:
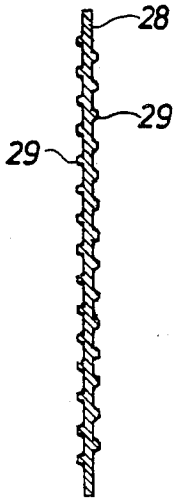

One embodiment in which such metal strips are used is shown in FIG. 6 in a plan view and in FIG. 7 in a section. In FIG. 6 one part of the channel 22 of the casing 19 in which the tube system, not shown in FIG. 6, is intended to be placed, is shown. Between the tubes of the tube system as well as between these tubes and the casing metal strips 28 are arranged and the length of these metal strips is substantially the same as the length of the straight parts 17 of the channel 22. Each metal strip 28 which is shown in a section in FIG. 7 is provided with a number of flanges or bulges 29. The height of these bulges determines the width of the slit between the tubes through which the second medium flows. It is suitable to make the bulges 29 with a wave form as shown in FIG. 6 so that a certain amount of guiding of the medium flow in accordance with the arrows shown in the drawing is obtained.

Figure 8:
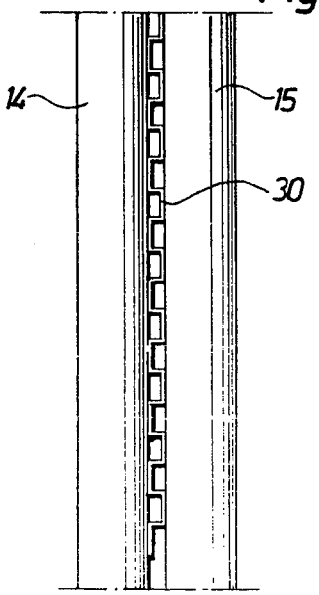

An alternative embodiment of the metal strips is shown in FIG. 8. In this case a metal strip 30 has been given a rectangular zig-zag form so that successive surfaces of the metal strip alternatingly abut the tubes 14 and 15, respectively. In a similar way metal strips are placed in the outer slits of the tube system. Such a design of the metal strips gives among other things an increase of the active outer surface of the tubes and as a result thereof an increased heat conductance.

I claim:

1. A heat exchanger comprising: a plurality of serpentine tubes which provide respective serpentine parallel flow paths for a first medium and which are arranged so that a gap is provided between each adjacent pair of said tubes; and a casing enclosing said tubes and having an inlet and an outlet for a second medium, said casing being internally shaped to define a serpentine channel containing said tubes, which channel connects said inlet to said outlet to provide a flow path for the second medium, and said heat exchanger further comprising a plurality of constraining means located along the channels for constraining the second medium to flow from one side of the channel to the other side thereof crosswise of said tubes and thereby, in cooperation with said casing, providing division of the flow of the second medium into a substantially pure counter-flow and a substantially pure cross-flow, the division of the flow of the second medium taking place at locations along the channels between: (i) the inlet and a constraining means positioned adjacent to the inlet, (ii) two adjacent constraining means; and (iii) the outlet and a constraining means positioned adjacent to the outlet.

2. A heat exchanger according to claim 1 wherein said casing is formed of two halves defining therebetween said flow path for the second medium.

3. A heat exchanger according to claim 2 wherein the two halves are substantially identical.

4. A heat exchanger according to claim 1, 2 or 3 wherein said casing is generally planar.

5. A heat exchanger according to claim 4 wherein the center line of each said tube lies in a plane parallel to the mean plane of the casing.

6. A heat exchanger according to claim 5 wherein said tubes are flattened in planes parallel to said mean plane and form narrow and elongate slits between adjacent tubes through which the second medium flows.

7. A heat exchanger according to claim 1 wherein said channel is formed from a plurality of straight substantially parallel portions linked together by substantially semi-circular portions.

8. A heat exchanger according to claim 7 wherein said constraining means comprises a plate disposed in at least one semi-circular portion of the channel and extending from the channel wall to a position adjacent to the tubes.

9. A heat exchanger according to claim 7 wherein said constraining means comprises at least one part of the internal wall of said channel, said at least one part being located in a said semi-circular channel portion and being disposed closely adjacent the tubes whereby passage of said second medium between the tubes and the said at least one part is at least substantially prevented.

10. A heat exchanger according to claim 1 wherein the tubes are provided with cross grooves.

11. A heat exchanger according to claim 1 wherein metal strips are positioned between adjacent tubes and between the tubes and the casing, said strips being provided with transverse flanges or bulges.

* * * * *

UNITED STATES PATENT AND TRADEMARK OFFICE

CERTIFICATE OF CORRECTION

PATENT NO. : 4,330,035

DATED : May 18, 1982

INVENTOR(S) : HILLERSTROM, Bjorn

It is certified that error appears in the above-identified patent and that said Letters Patent are hereby corrected as shown below:

On The Title Page,

Inventor's name should read -- Bjorn Hillerstrom --.

Signed and Sealed this

*Thirty-first* Day of *August 1982*

[SEAL]

*Attest:*

GERALD J. MOSSINGHOFF

*Attesting Officer*

*Commissioner of Patents and Trademarks*